US011843170B2

(12) United States Patent
Bamford

(10) Patent No.: US 11,843,170 B2
(45) Date of Patent: Dec. 12, 2023

(54) SPHERICAL LUNEBURG LENS-ENHANCED COMPACT MULTI-BEAM ANTENNA

(71) Applicant: JOHN MEZZALINGUA ASSOCIATES, LLC, Liverpool, NY (US)

(72) Inventor: Lance Bamford, Pittsford, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 42 days.

(21) Appl. No.: 17/439,444

(22) PCT Filed: Sep. 25, 2019

(86) PCT No.: PCT/US2019/052930

§ 371 (c)(1),
(2) Date: Sep. 15, 2021

(87) PCT Pub. No.: WO2020/190331

PCT Pub. Date: Sep. 24, 2020

(65) Prior Publication Data

US 2022/0158354 A1 May 19, 2022

Related U.S. Application Data

(60) Provisional application No. 62/819,117, filed on Mar. 15, 2019.

(51) Int. Cl.
*H01Q 15/08* (2006.01)
*H01Q 19/06* (2006.01)
(Continued)

(52) U.S. Cl.
CPC ..... *H01Q 15/08* (2013.01); *H01Q 13/085* (2013.01); *H01Q 19/062* (2013.01); *H01Q 21/20* (2013.01); *H01Q 21/24* (2013.01); *H01Q 25/008* (2013.01)

(58) Field of Classification Search
CPC ..... H01Q 15/08; H01Q 19/062; H01Q 21/20; H01Q 21/24; H01Q 25/008; H01Q 13/085;
(Continued)

(56) References Cited

U.S. PATENT DOCUMENTS 3,757,333 A * 9/1973 Procopio ..... H01Q 3/245 342/372
6,046,701 A * 4/2000 Carey ..... H01Q 3/24 343/753
(Continued)

FOREIGN PATENT DOCUMENTS

CN 109378585 A 2/2019
EP 3242358 A1 11/2017
WO 2010-016799 2/2010

OTHER PUBLICATIONS

International Search Report and Written Opinion dated Jan. 15, 2020, from International Application No. PCT/US2019/052930, 10 pages.
(Continued)

*Primary Examiner* — Vibol Tan
(74) *Attorney, Agent, or Firm* — Meunier Carlin & Curfman LLC

(57) ABSTRACT

Disclosed is an antenna having a plurality of radiators disposed in a ring or arc around a Luneburg lens. Each of the radiators (e.g., flared-notch radiators) has a center radiating axis that intersects with the center of the Luneburg lens. Each of the radiators radiate into the Luneburg lens such that the Luneburg lens substantially planarizes the beam emitted by each radiator (on transmit) and focuses an incoming wavefront into the radiator (on receiver). This not only enables having numerous well-controlled individual beams,
(Continued)

it also allows for combining radiators to create well-defined sector beams with minimal sidelobes and fast rolloff.

22 Claims, 11 Drawing Sheets

(51) Int. Cl.
*H01Q 21/20* (2006.01)
*H01Q 25/00* (2006.01)
*H01Q 21/24* (2006.01)
*H01Q 13/08* (2006.01)

(58) Field of Classification Search
CPC ..... H01Q 25/00; G02B 3/0087; G02B 2003/0093
See application file for complete search history.

(56) References Cited

U.S. PATENT DOCUMENTS 6,127,984 A * 10/2000 Klebe ..... H01Q 13/10 343/770
6,208,288 B1 * 3/2001 Shoucri ..... H01Q 15/08 342/36
6,219,000 B1 * 4/2001 McWhirter ..... H01Q 13/085 343/770
7,420,525 B2 * 9/2008 Colburn ..... H01Q 19/062 343/753
7,688,263 B1 * 3/2010 Oxley ..... G01S 3/043 342/56
7,796,080 B1 * 9/2010 Lynch ..... G01S 13/89 343/911 L
8,350,773 B1 * 1/2013 Kindt ..... H01Q 21/068 343/770
8,854,257 B2 10/2014 Hamner et al.
10,256,551 B2 * 4/2019 Shehan ..... H01Q 1/526
11,385,384 B2 * 7/2022 Diehl ..... G02B 3/0087
2005/0219126 A1 * 10/2005 Rebeiz ..... H01Q 25/008 343/700 MS
2007/0296640 A1 12/2007 Colburn et al.
2013/0082889 A1 4/2013 Le Bars et al.
2017/0062944 A1 3/2017 Zimmerman et al.
2017/0324171 A1 11/2017 Shehan
2018/0337442 A1 11/2018 Deng
2021/0210850 A1 * 7/2021 Hayles, Jr. ..... H01Q 1/246

OTHER PUBLICATIONS

Gao, Ju, et al. "Beam steering performance of compressed Luneburg lens based on transformation optics." Results in Physics 9 (2018): 570-575.
Baev, et al., "Lüneburg Lenses as Communication Antennas", Annuaire de l'Universite de Sofia "St. Kliment Ohridski", Faculte de Physique, 102, 2009. 67-84.
How it Works, How Lens Technology works and what advantages it bring over traditional antenna designs: Luneburg Lenses are capable of taking an incoming plane and focusing the wave through refraction onto the opposite side of the Lens. 2019.
Liang, "A 3-D Luneburg Lens Antenna Fabricated by Polymer Jetting Rapid Prototyping", IEEE Transactions on Antennas and Propagation, vol. 62, No. 4, Apr. 2014. 1799-1807.
Guillet, et al., Millimeter waves reflector with Lüneburg lenses. POEM/ISUPTW (LTST) Technical Digest © OSA 2012. 2 pages.
Matsing, Lens Technology Enabled, MS-6.3DB90-A. 2 pages.
Matsing, Lens Technology Enabled, MS-8.4DB120. 2 pages.
Valention, et al., Design and Fabrication of Hohogeneous Dielectric Lenses for Dome Antennas, AP 15-10, 1980, 580-583.
Extended European Search Report, dated Nov. 21, 2022, received in connection with corresponding EP Patent Application No. 19920259.9.
Ryazantsev, R.O., et al., "Concave Spherical Feed Array for Luneberg Lens," IEEE International Siberian Conference on Control and Communications (SIBCON), 2013, 4 pages.
Office Action issued in corresponding JP Patent App. No. 2021-555443 dated Oct. 24, 2023 (with English-language machine translation) (8 pages).

* cited by examiner

SPHERICAL LUNEBURG LENS-ENHANCED COMPACT MULTI-BEAM ANTENNA

BACKGROUND OF THE INVENTION

Field of the Invention

The present invention relates to wireless communications, and more particularly, to compact multi-beam antennas.

Related Art

There is a strong demand for compact antennas to be able to provide multi-sector coverage with minimal gain pattern overlap between sectors. Sidelobe overlap between sector gain patterns can cause significant inter-sector interference that can seriously degrade the antenna's SINR (Signal to Interference and Noise Ratio). The more compact the antenna, the worse the inter-sector interference problem becomes. Accordingly, mitigating the inter-sector interference problem generally involves increasing the size of the antenna.

A further deficiency of conventional multi-beam antennas is that they are generally fixed in their beam configuration. Accordingly, a given antenna may have three 120-degree sectors, or six 60-degree sectors, etc., but are not reconfigurable once fixed.

Accordingly, there is a need for a compact multi-beam antenna that substantially mitigates inter-sector interference while also providing the ability to dynamically reconfigure itself for different numbers and angular ranges of sectors.

SUMMARY

Accordingly, the present invention is directed to a spherical Luneberg lens-enhanced compact multi-beam antenna that obviates one or more of the problems due to limitations and disadvantages of the related art.

An aspect of the present invention involves an antenna, which comprises a spherically symmetric gradient-index lens, and a first plurality of radiators disposed in a first ring configuration around the spherically symmetric gradient-index lens, each of the first plurality of radiators having a center radiating axis that points toward a center of the spherically symmetric gradient-index lens.

It is to be understood that both the foregoing general description and the following detailed description are exemplary and explanatory only, and are not restrictive of the invention as claimed.

BRIEF DESCRIPTION OF THE DRAWINGS

The accompanying figures, which are incorporated herein and form part of the specification, illustrate a spherical Luneburg lens-enhanced compact multi-beam antenna. Together with the description, the figures further serve to explain the principles of a spherical Luneburg lens-enhanced compact multi-beam antenna described herein and thereby enable a person skilled in the pertinent art to make and use the spherical Luneburg lens-enhanced compact multi-beam antenna.

DESCRIPTION OF EXEMPLARY EMBODIMENTS

Reference will now be made in detail to embodiments of the spherical Luneburg lens-enhanced compact multi-beam antenna according to principles described herein with reference to the accompanying figures. The same reference numbers in different drawings may identify the same or similar elements.

Figure 1A:
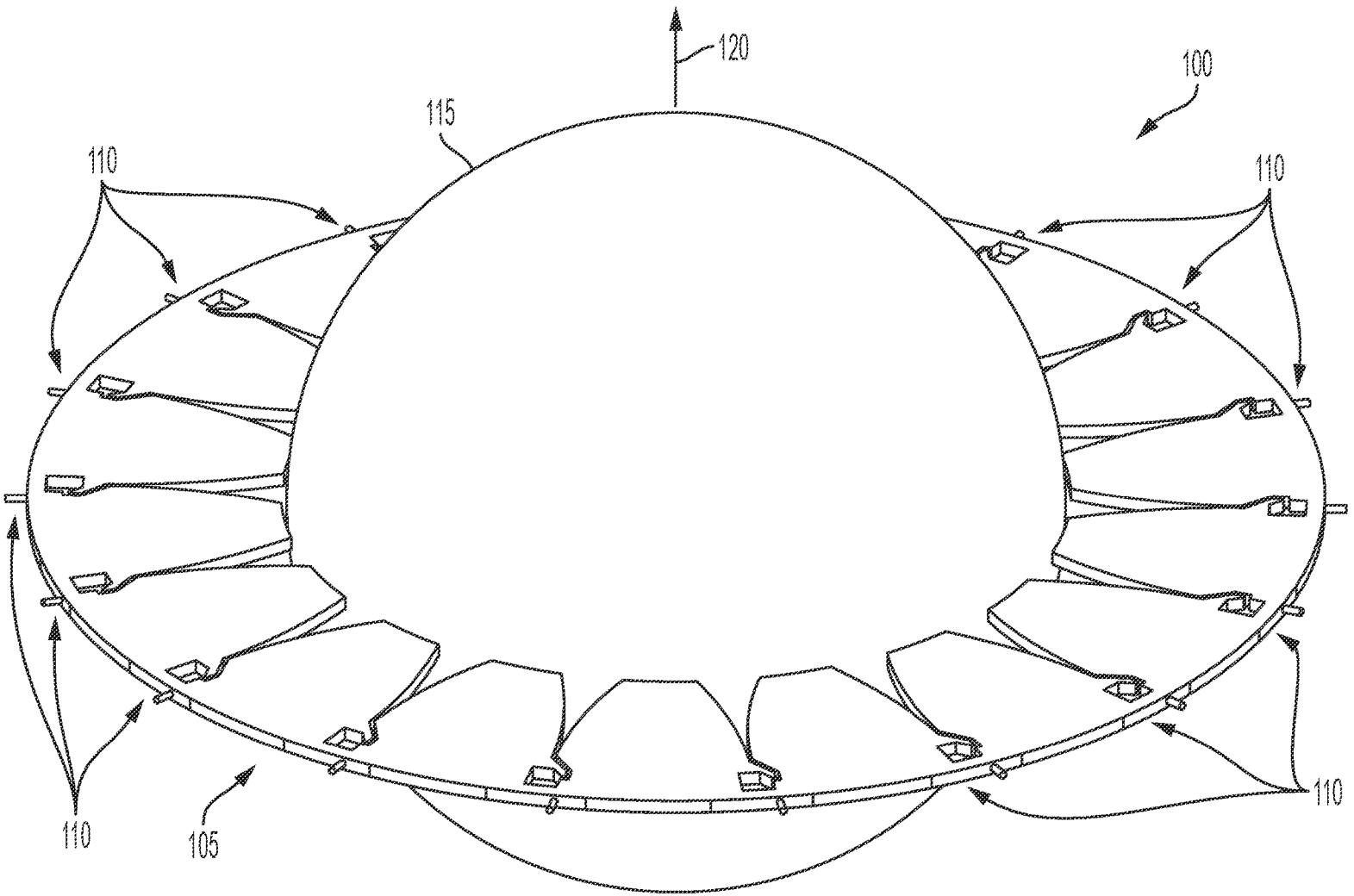
FIG. 1*a* illustrates an exemplary antenna according to the disclosure.

FIG. 1*a* illustrates an exemplary antenna 100 according to the disclosure. Antenna 100 includes a radiator ring 105, which includes a plurality of flared-notch radiators 110. The radiator ring 105 surrounds a spherically symmetric gradient-index lens, such as a Luneburg lens 115. In the illustrated example, the radiator ring 110 has eighteen flared-notch radiators (also known as Vivaldi radiators or tapered-slot radiators). Further to this example, the antenna 100 is configured to operate in a frequency range of 1695 MHz to 4300 MHz; the Luneburg lens has a diameter of 400 mm; and each of the eighteen flared-notch radiators 110 are configured to radiate in an approximate 20-degree wide gain pattern. The radiator ring 105 may encompass Luneburg lens 115, centered around the spherical center of Luneburg lens 105, with an elevation axis 120 that intersects the spherical center of Luneburg lens 105, such that radiator ring 105 is disposed in an axially symmetric fashion around elevation axis 120.

The Luneburg lens 115 is a sphere having a concentrically-graded refractive index. They are known in the field of microwave engineering. Luneburg lens 115 may have a continuous grading of refractive index from the spherical center to its outer surface. Alternatively, Luneburg lens 115 may have a step gradient in refractive index. Luneburg lens 115 serves to substantially focus and planarize the RF wavefront emitted by each flared-notch radiator 110, whereby each flared-notch radiator 110 radiates inward toward the spherical center of the Luneburg lens 115. As a receiver, the Luneburg lens 115 focuses a substantially planar wavefront into an aperture defined by a given flared-notch radiator 110. The Luneburg lens 115 of exemplary antenna 100 has a diameter of 400 mm, although varying diameters are possible and within the scope of the disclosure. Exemplary Luneburg lens 115 is described in further detail below. The Luneberg lens may be made of any suitable material, including, for example, Acrylonitrile butadiene styrene (ABS), which has a dielectric constant of 3 with a reasonable loss tangent. Other thermoplastic polymers may be used. The Luneberg lens may be made by 3D printing or other suitable method.

Figure 1B:
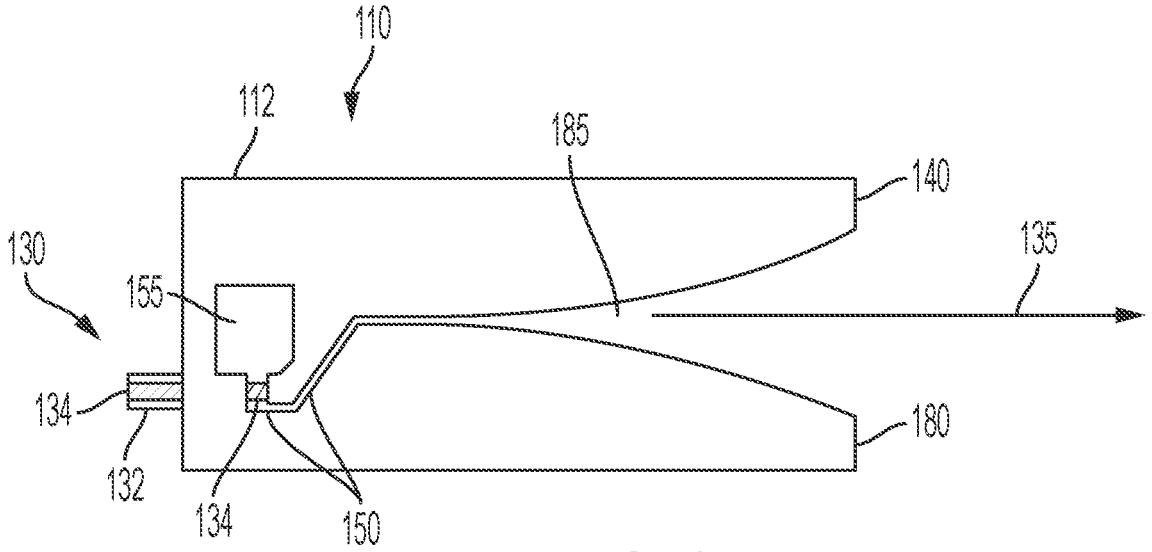
FIG. 1*b* illustrates an exemplary flared-notch radiator according to the disclosure.

FIG. 1*b* illustrates an exemplary flared-notch radiator 110 according to the disclosure. Flared-notch radiator 110 has a conductive plate 112 that has cutouts that define a traveling wave slot 145, a slot line 150, and a slot line termination cavity 155. Flared-notch radiator 110 also includes a coaxial feed 130 that has an outer conductor 132 and an inner conductor 134. As illustrated in FIG. 1*b*, outer conductor 132 is coupled to conductive plate 112 at the point where conductive plate 112 mates with coaxial feed 130. Inner conductor 134 passes through conductive plate 112 at the point where conductive plate 112 mates with coaxial feed 130, shrouded by a dielectric (not shown), and passes through slot line 150, where it is coupled to conductive plate 112 on the other side of slot line 150.

Traveling wave slot 145 may define a center radiating axis 135, which substantially defines a central axis for the gain pattern of flared-notch radiator 110. Flared-notch radiator 110 also has two forward edges 140, each on either side of traveling wave slot 145. The forward edges 140 define the portion of flared-notch radiator 110 that contacts the outer surface of Luneburg lens 115.

Flared-notch radiator 110 may be of a conventional variety, with dimensional parameters set according to desired frequencies and bandwidth.

Conductive plate 112 may be formed of copper, aluminum, brass, or other metals. Further, conductive plate 112 may be formed of a thin plate. Having each flared-notch radiator 110 (and thus radiator ring 105) formed of a thin plate may reduce its interfering with the gain pattern of the flared-notch radiators 110 on the opposite side of radiator ring 105 (on the other side of Luneburg lens 115).

Figure 1C:
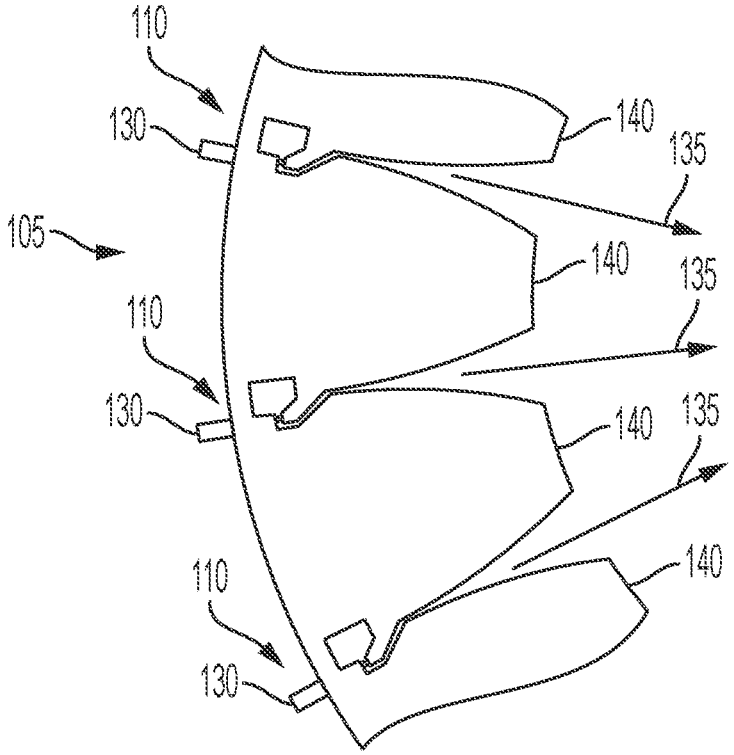
FIG. 1*c* illustrates a portion of a radiator ring having a plurality of flared-notch radiators.

FIG. 1*c* illustrates a portion of radiator ring 105, having a plurality of flared-notch radiators 110. Illustrated are their combined forward edges 140 that contact the outer surface of Luneburg lens 115 (not shown) and their respective center radiating axes 135, each of which may intersect with the spherical center of Luneburg lens 115.

Figure 1D:
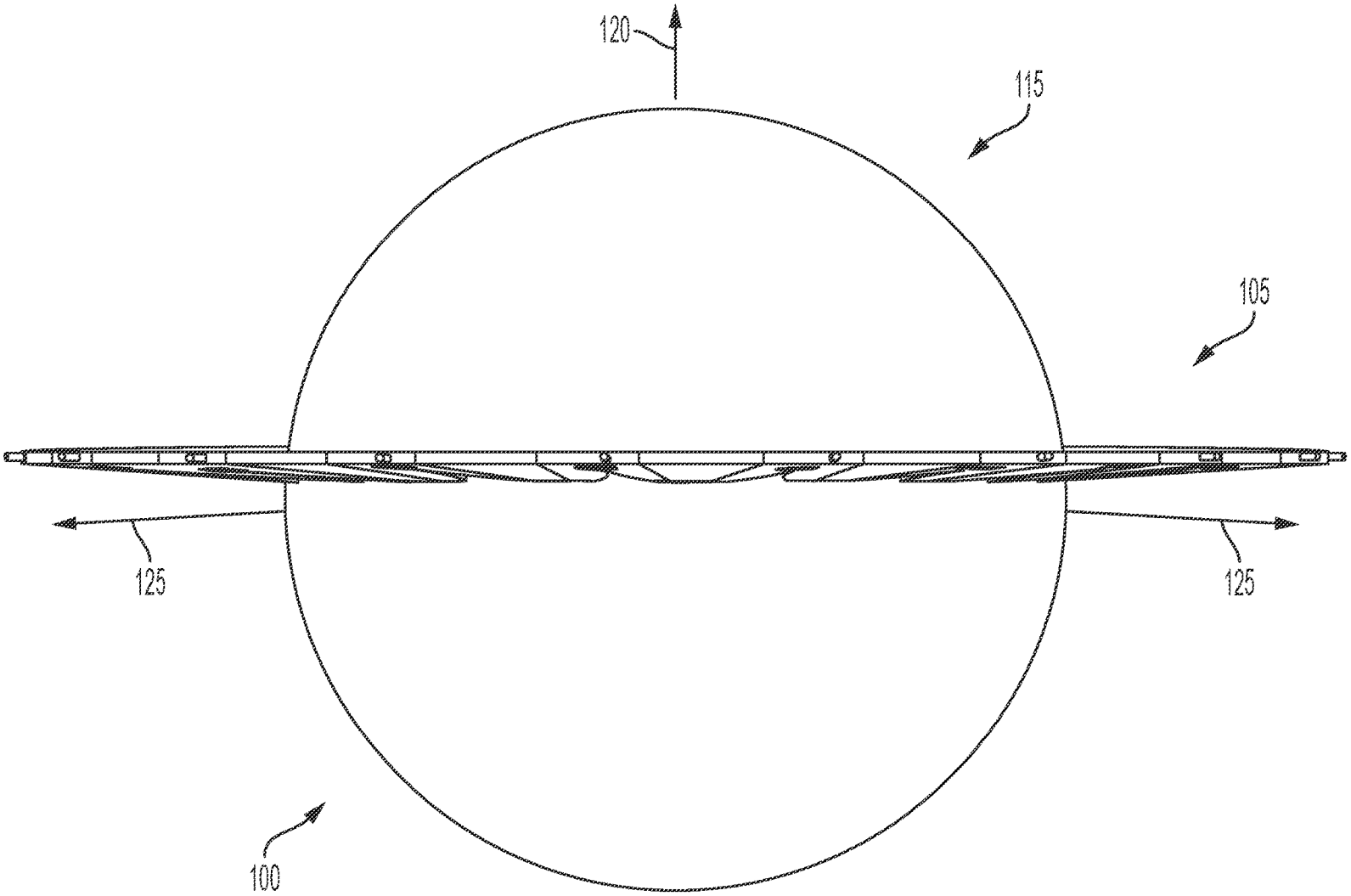
FIG. 1*d* illustrates an exemplary antenna from an orientation orthogonal to the antenna's elevation axis.

FIG. 1*d* illustrates exemplary antenna 100 from an orientation orthogonal to elevation axis 120. As illustrated, in exemplary antenna 100, radiator ring 105 is oriented and disposed on Luneburg lens 115 such that it has a latitude offset of 4 degrees. Accordingly, each flared-notch radiator 110 of radiator ring 105 is oriented such that its center radiating axis 135 intersects the spherical center of Luneburg lens 115 from a latitude offset of 4 degrees. Further, the forward edge 140 of each flared-notch radiator 110 substantially contacts Luneburg lens 115 such that each forward edge 140 contacts the Luneburg lens 115 along a latitudinal plane that is at a 4 degrees of latitude above an equatorial plane 125 of the Luneburg lens 115, whereby the equatorial plane 125 of the Luneburg lens 115 is orthogonal to the elevation axis 120.

The exemplary 4-degree latitudinal offset of radiator ring 105 causes each flared-notch radiator 110 to aim its gain pattern downward at a 4-degree angle. In doing so, interference caused by the presence of the flared-notch radiators 110 on the opposite side of radiator ring 105 (and Luneburg lens 115) is reduced. Further, having the gain patterns of flared-notch radiators 110 point downward may be advantageous in deployments whereby antenna 100 is mounted above the User Equipment (UE) in the intended coverage area.

Figure 2:
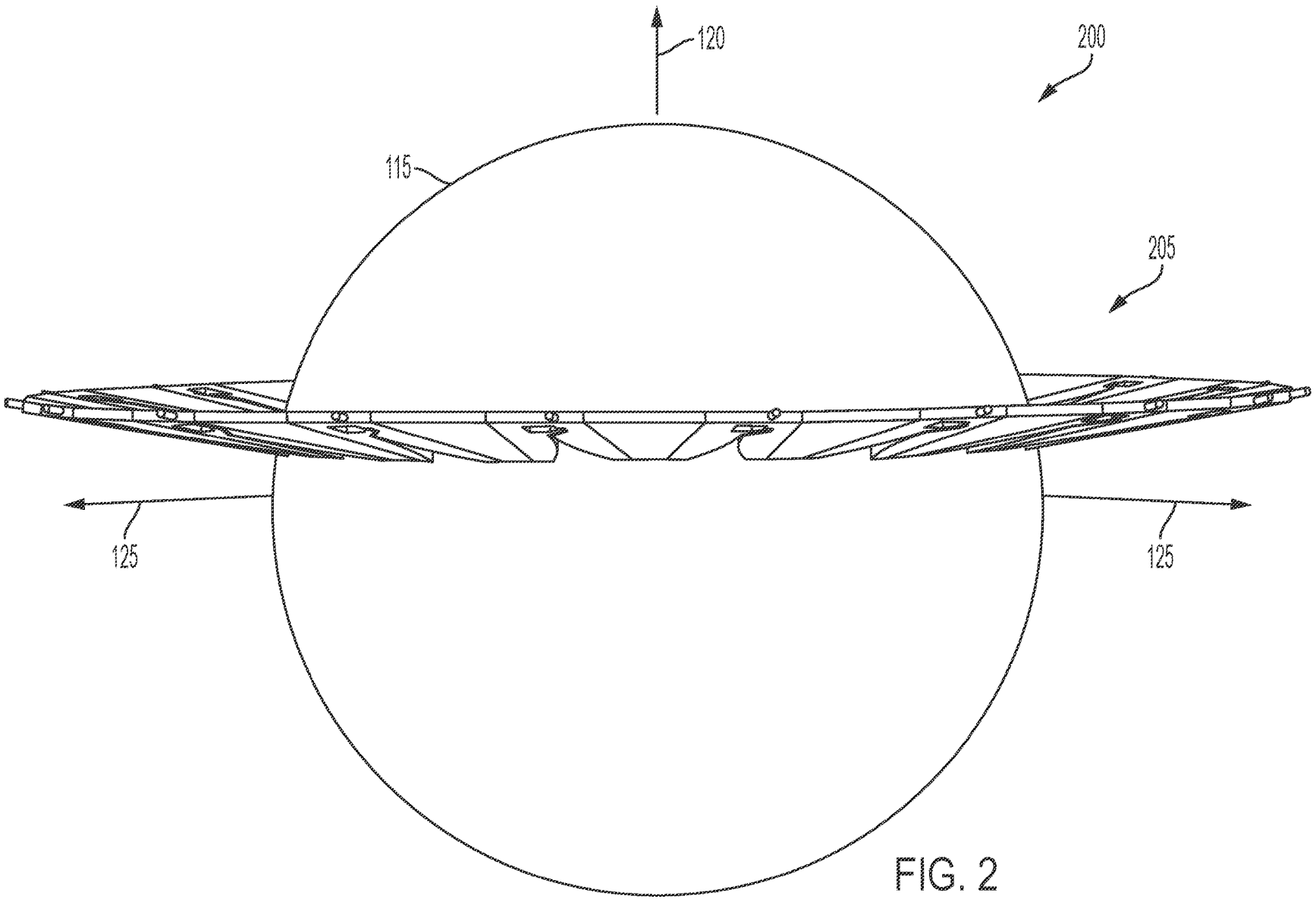
FIG. 2 illustrates an exemplary antenna having a radiator ring with a steeper latitudinal orientation.

FIG. 2 illustrates another exemplary antenna 200 according to the disclosure. The illustration of FIG. 2 is at the same orientation as FIG. 1*d* in that the view is along the equatorial plane 125 and elevation axis 120 is oriented vertically. The differentiation of antenna 200 is that radiator ring 205 is oriented such that the forward edges 140 of the flared-notch radiators 110 contact Luneburg lens 115 along a latitudinal plane that is 10 degrees offset from the equatorial axis 125. The center radiating axes 135 of the flared-notch radiators 110 thus intersect the spherical center of Luneburg lens 115 at an angle of 10 degrees relative to the equatorial plane 125, and at an angle of 80 degrees relative to elevation axis 120.

As with antenna 100, the exemplary 10-degree latitudinal offset of radiator ring 205 causes each flared-notch radiator 110 to aim its gain pattern downward at an angle of 10 degrees, with antenna 200 pointing its respective gain patterns further downward relative to antenna 100. In doing so, interference experienced by antenna 200 caused by the presence of the flared-notch radiators 110 on the opposite side of radiator ring 205 (and Luneburg lens 115) is also further reduced relative to antenna 100. Similarly, having the gain patterns of flared-notch radiators 110 point downward may be more advantageous in deployments whereby antenna 100 is mounted above the UEs in the intended coverage area. A complication with antenna 200 is that it may be more complex to manufacture a radiator ring 205 with a 10-degree latitudinal offset relative to one with a 4-degree offset.

Variations to antennas 100/200 are possible and within the scope of the disclosure. For example, radiator ring 105 may be flat and formed around the equatorial plane 125 of Luneburg lens 115. This may make radiator ring much easier and much less costly to manufacture. Although this may come at the expense of increased interference for each flared-notch radiator 110 by those on the opposite side of radiator ring 105 and Luneburg lens 115, this may be tolerable, especially if radiator ring 105 is formed of a very thin metal. Further, depending on how antenna 100/200 may be deployed and its expected coverage, the latitudinal angle of radiator ring 105 may be greater than 10 degrees. There is a tradeoff in that the greater the latitudinal angle of radiator ring 105, the interference effect diminishes, but given the reduced diameter of radiator ring 105 with higher latitude, there is less room for flared-notch radiators 110. Accordingly, the tradeoff may be between reduced interference but fewer flared-notch radiators 110. It will be understood that such variations are possible and within the scope of the disclosure.

Figure 3:
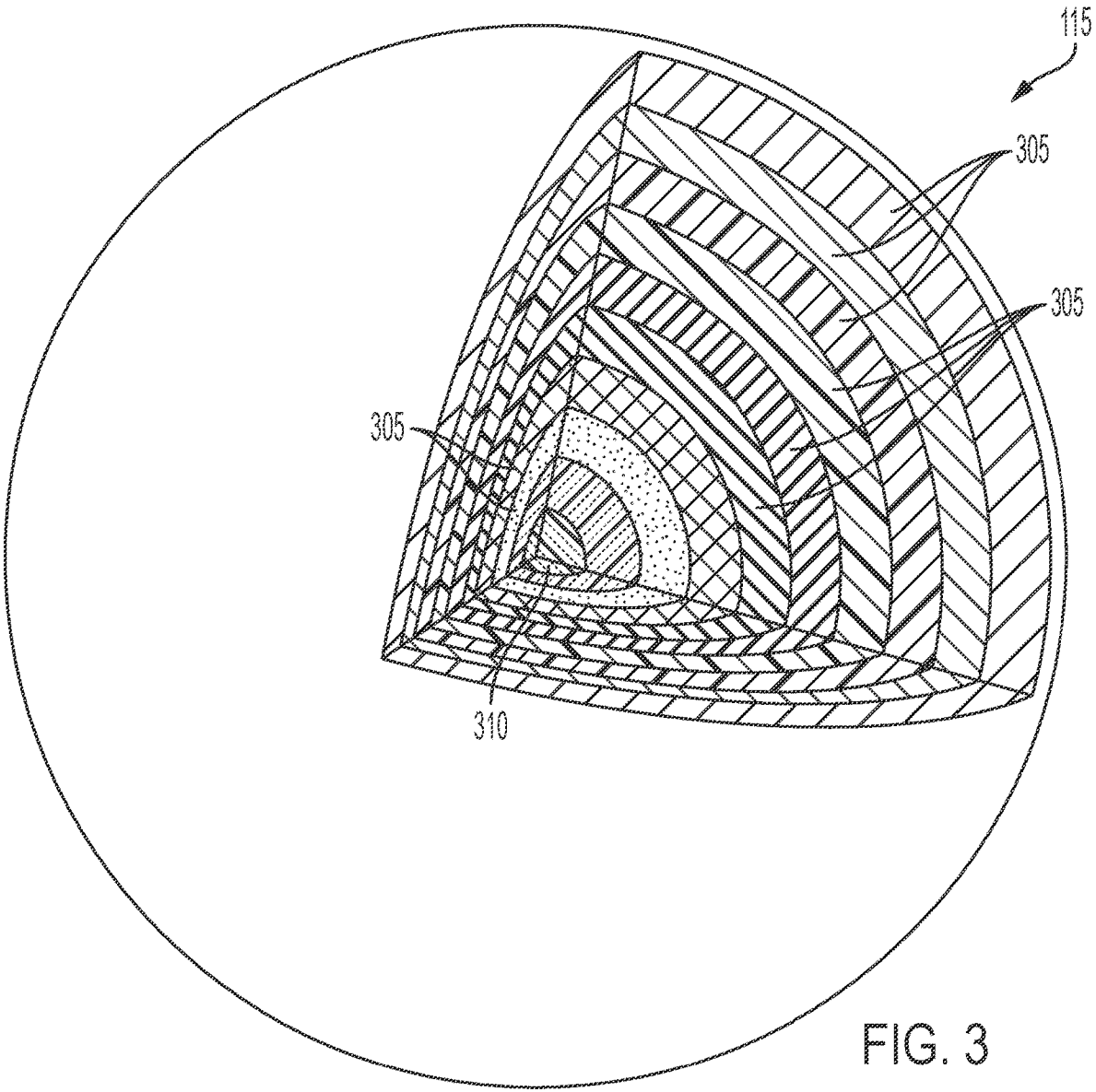
FIG. 3 is a cutaway view of an exemplary Luneburg lens according to the disclosure.

FIG. 3 is a cutaway view of an exemplary Luneburg lens 115 according to the disclosure. Exemplary Luneburg lens 115 may be made of a series of concentric shells 305 formed around a central sphere 310. In this example, each individual shell 305 has a uniform and distinct refractive index. The refractive indices for each of the shells 305 may be predetermined according to the following relation, $$n(r)^2 = \varepsilon_r(r) = 2 - \left(\frac{r}{R}\right)^2,$$

whereby $\varepsilon_r$ is the relative permittivity, R is the radius of the lens, and r is the radial distance from the a given shell 305 to the spherical center of Luneburg lens 115. In an exemplary embodiment, Luneburg lens 115 may have an outer surface radius of 200 mm and be formed of 9 shells 305 formed around central sphere 310. The relative permittivity of each of these may be as follows:

| Shell number | Outer radius (mm) | $\varepsilon_r$ |
|---|---|---|
| Center sphere | 20 | 2 |
| 1 | 40 | 1.99 |
| 2 | 60 | 1.96 |
| 3 | 80 | 1.91 |
| 4 | 100 | 1.84 |
| 5 | 120 | 1.75 |
| 6 | 140 | 1.64 |
| 7 | 160 | 1.51 |
| 8 | 180 | 1.36 |
| 9 | 200 | 1.19 |

The above-described exemplary Luneburg lens 115 may provide sufficient focusing for well-defined beams with minimal sidelobes for an antenna 100/200 to operate in a frequency range of 1695 MHz to 4300 MHz, using eighteen flared-notch radiators 110, each having a 20-degree beamwidth. It will be understood that variations to Luneburg lens 115, as described above, are possible and within the scope of the disclosure. For example, Luneburg lens 115 may be formed of graded index spheres involving 3D printed elements supported by a three dimensional grid scaffold, as well as other techniques for forming a sphere that has a graded refractive index that has a maximum index at the center and a minimum index at the surface.

Figure 4:
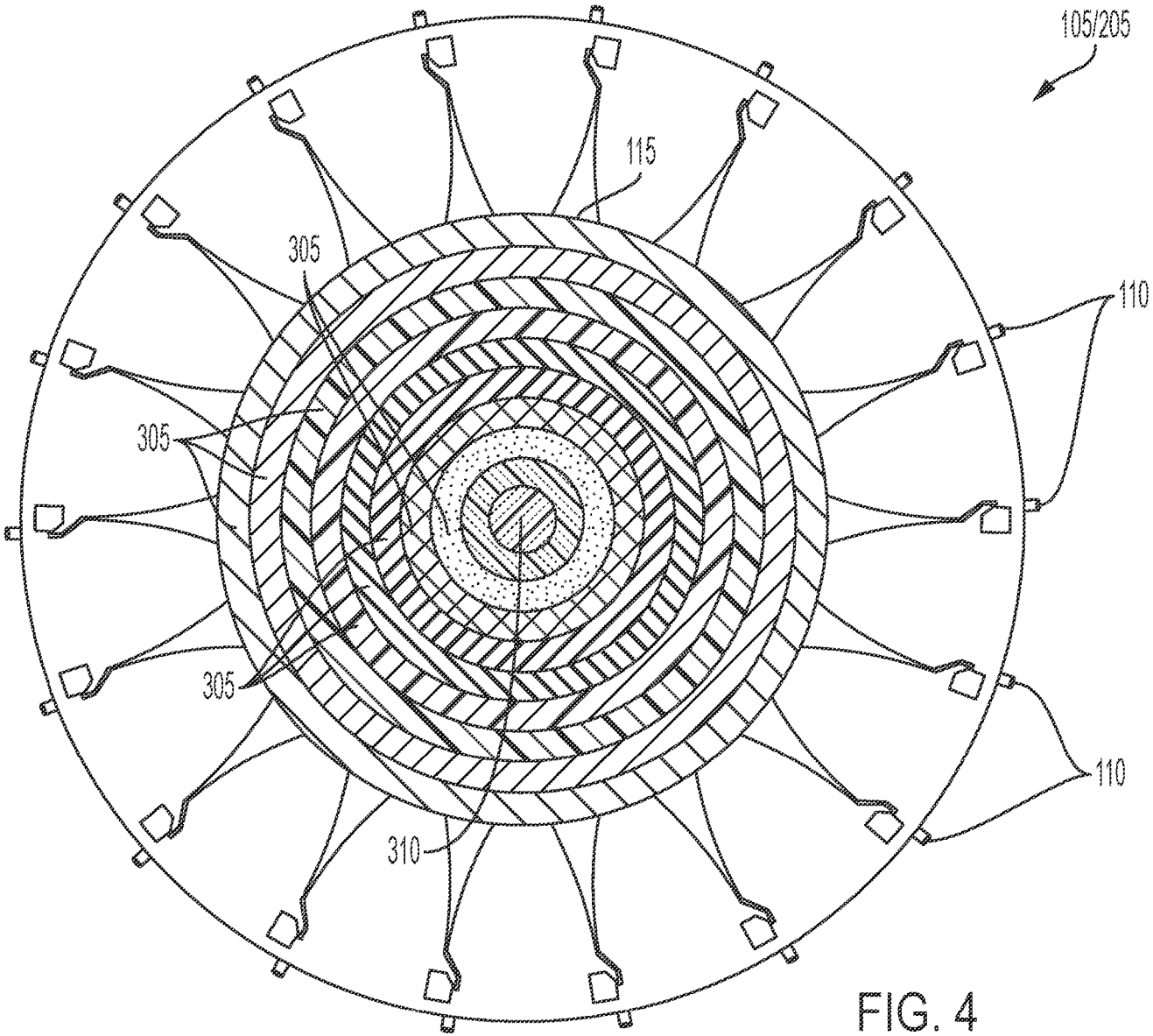
FIG. 4 is a top-down view of an exemplary antenna according to the disclosure, providing a cutaway view of the concentric shells and central sphere within the antenna's Luneburg lens as well as its radiator ring.

FIG. 4 is a top-down view along the elevation axis 120 of antenna 100/200, providing a cutaway view of the different shells 305 and central sphere 310 within Luneburg lens 115 as well as radiator ring 105/205.

Figure 5:
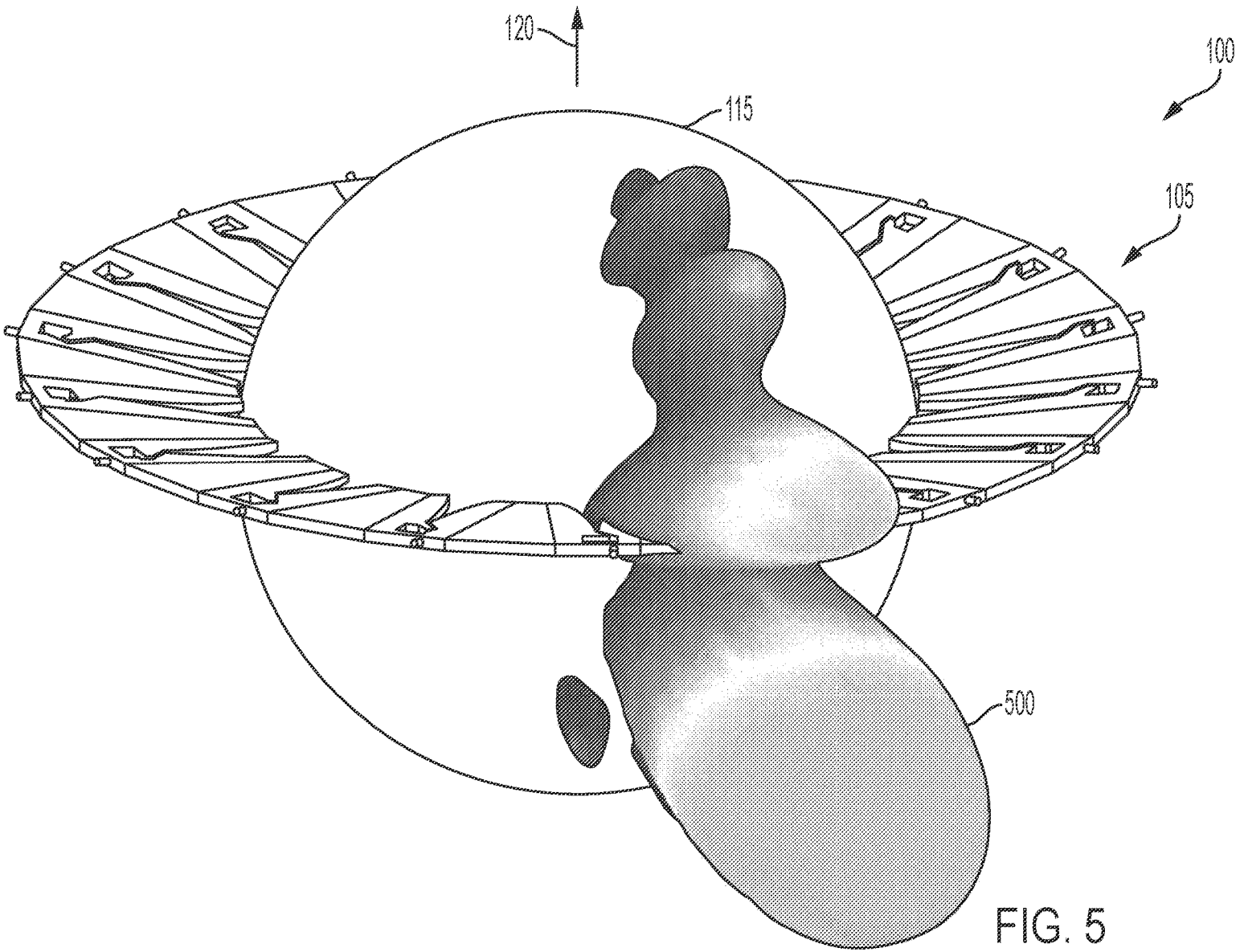
FIG. 5 depicts an exemplary antenna with one flared-notch radiator 110 emitting an RF signal, illustrating an exemplary beam emitted by the Luneburg lens.

FIG. 5 depicts exemplary antenna 200 with one flared-notch radiator 110 emitting an RF signal at 2650 MHz. In the illustration, the active flared-notch radiator is obscured by the Luneburg lens 115, and therefore is not illustrated in FIG. 5. A focused beam 500 is emitted through the side of the Luneburg lens 115 opposite the active flared-notch radiator.

Antenna 100/200 may be operated in different configurations to provide different beam widths and different numbers of independent beams. For example, if each flared-notch radiator 110 is operated independently, antenna 100/200 may enable eighteen distinct sectors, each with a 20-degree beamwidth with minimal overlap. Alternatively, different combinations of contiguous flared-notch radiators 110 may be commonly fed such that antenna 100/200 may have fewer sectors with broader coverage. Depending on the feed circuitry (not shown), antenna 100/200 may be reconfigured dynamically to provide different sector coverage or beam scanning. For example, antenna 100/200 can be configured so that the flared-notch radiators 110 may be grouped into three arcs of 6 flared-notch radiators each. This results in a three-sector antenna with each sector having 120 degrees of coverage. Similarly, antenna 100/200 may be fed to operate with six sectors of 60 degrees of coverage, or twelve sectors of 30 degrees of coverage. It will be understood that such variations are possible and within the scope of the disclosure.

Figure 6:
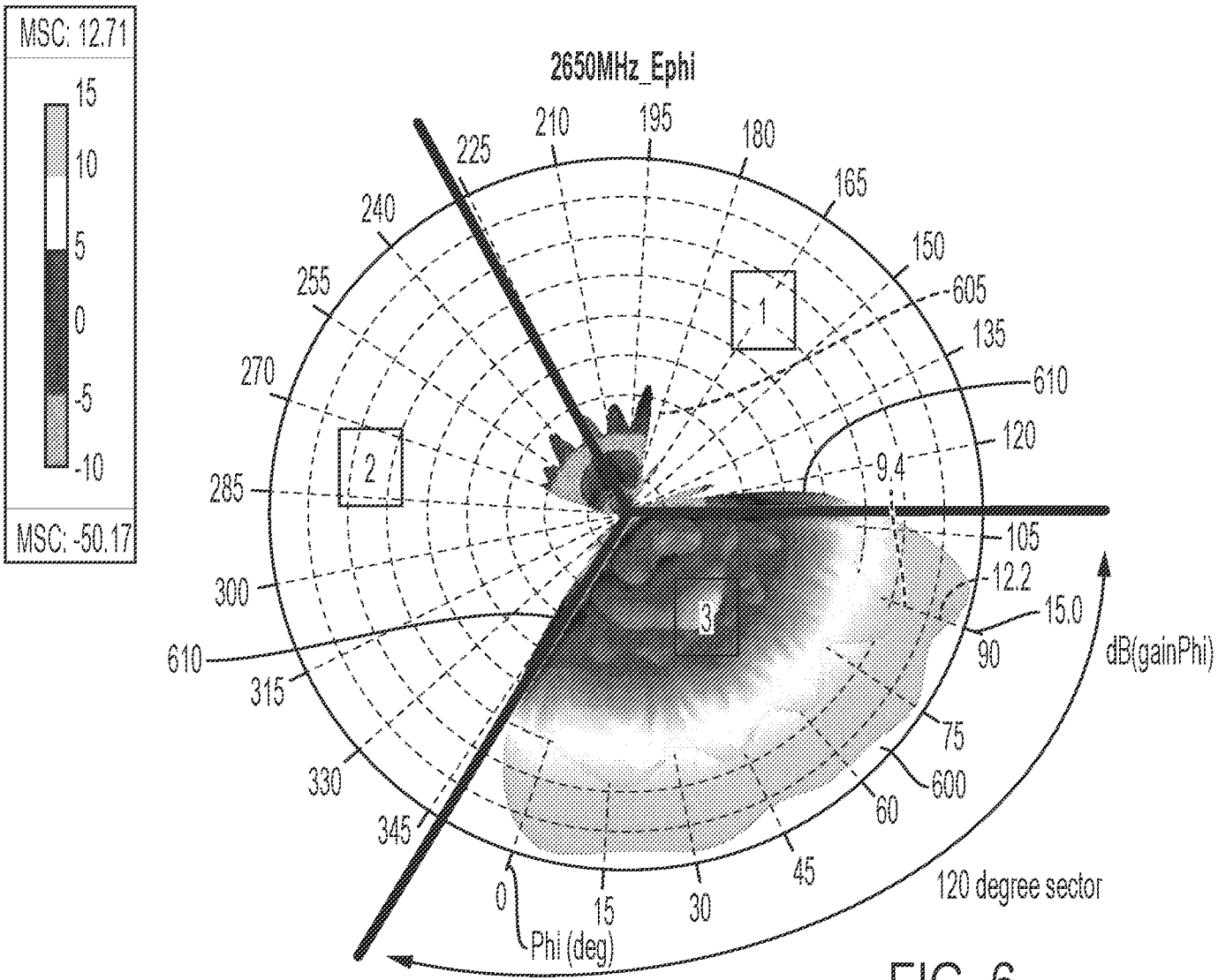
FIG. 6 illustrates an exemplary gain pattern corresponding to mutually activating six adjacent flared-notch radiators 110, each with a 20-degree beamwidth, to create a 120-degree sector.

FIG. 6 illustrates an exemplary gain pattern 600 corresponding to mutually activating six adjacent flared-notch radiators 110, each with a 20-degree beamwidth, to create a 120-degree sector. As illustrated, gain pattern 600 has minimal rear lobes 605 and minimal overlap 610 with an adjacent sector (fast rolloff). The beamshaping enabled by activating adjacent flared-notch radiators 110 may provide for significant improvement in beam quality and minimal inter-sector interference.

Further to this example, in activating multiple adjacent flared-notch radiators 110, each of the flared-notch radiators 110 may be allocated different power levels such that the flared-notch radiator(s) 110 at the center of a cluster of adjacent flared-notch radiators may be fed with greater power, and the flared-notch radiators 110 disposed away from the center flared-notch radiators 110 may be fed with less power. This differential powering of the activated flared-notch radiators 110 may contribute to improved beamshaping. It will be understood that such variations are possible and within the scope of the disclosure.

Figure 7A:
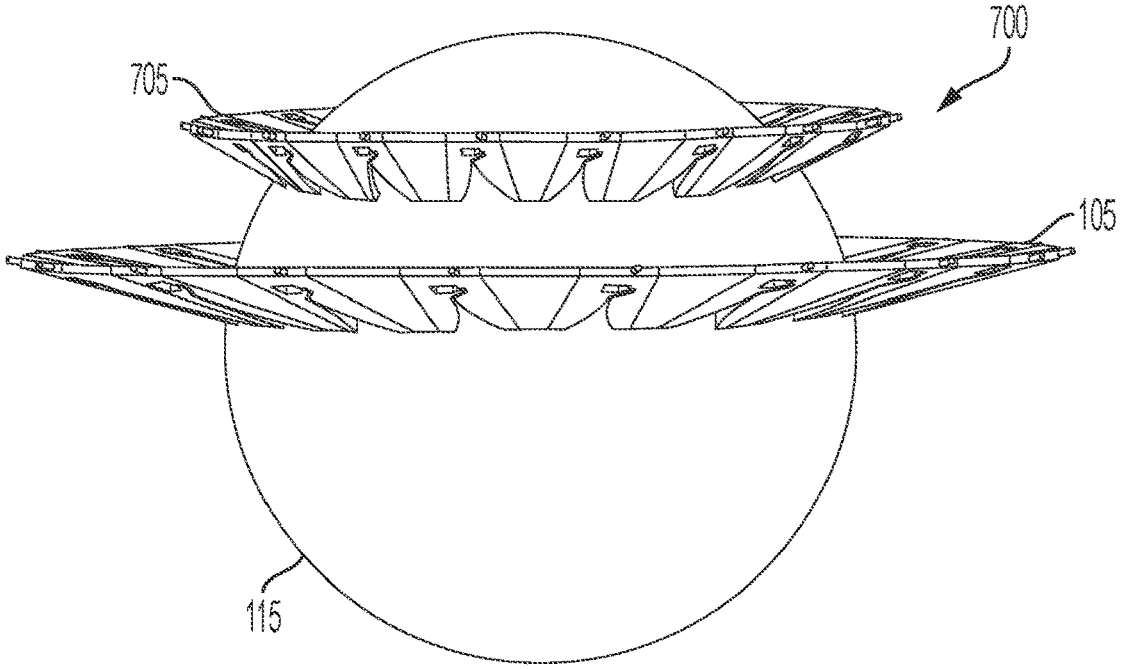
FIG. 7*a* illustrates one perspective of an exemplary antenna having two radiator rings.
Figure 7B:
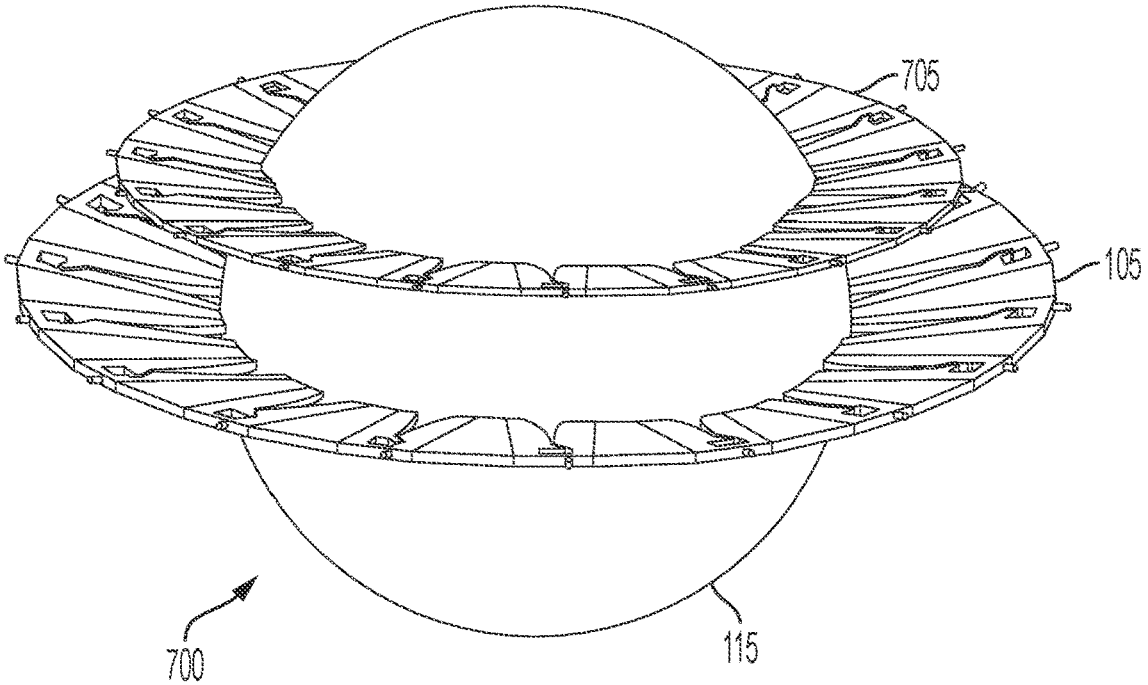
FIG. 7*b* illustrates another perspective of an exemplary antenna having two radiator rings.

FIGS. 7*a* and 7*b* illustrate an exemplary antenna 700, which may be substantially similar to antenna 100/200 but has an additional radiator ring 705. The latitudinal plane of radiator rings 105 and 705 may be set in order to provide two separate sectors in elevation (along the elevation axis 120) as well as any number of combination of sectors in azimuth (around the elevation axis 120). Radiator rings 105 and 705 may have the same number of flared-notch radiators 110 or a different number, which may depend on the radius of radiator ring 705. Further, flared-notch radiators 110 may be combined such that one may be paired with its counterpart in the other upper/lower ring to form a combined beam with improved beamshaping and sectorization along the elevation axis as well as in azimuth. This may be done for a single 20-degree beam, 60-degree sector, 120-degree sector, etc.

Further to the examples illustrated in FIGS. 7*a* and 7*b*, exemplary antenna 700 may have additional radiator rings (not shown) disposed along higher latitudinal planes. In this example, the "higher" the radiator ring along the elevation axis, the greater the performance due to diminished interference from flared-notch radiators 110 on the opposite side of the radiator ring, although there may be fewer flared-notch radiators 110 on the higher-latitude radiator ring(s). For example, the higher ring placements on top of the lens give rise to greater beam tilt angles, below the lens, e.g., 30 degree ring placement above the equator would give rise to a 30 degree beam tilt below the equator. An additional advantage of having more radiator rings with increasing latitude is that it enables sectorization and beamshaping in two dimensions: along the elevation axis as well as in azimuth. This may enable beamforming with multiple independent beams encompassing the entire substantially hemispheric coverage area of antenna 700 and may provide for multi-user MIMO capability within the coverage area. Further, the flared-notch radiators 110 of higher latitude radiator rings may be provided higher power relative to the corresponding flared-notch radiators 110 of radiator rings closer to the equatorial plane of Luneburg lens 115.

Figure 8A:
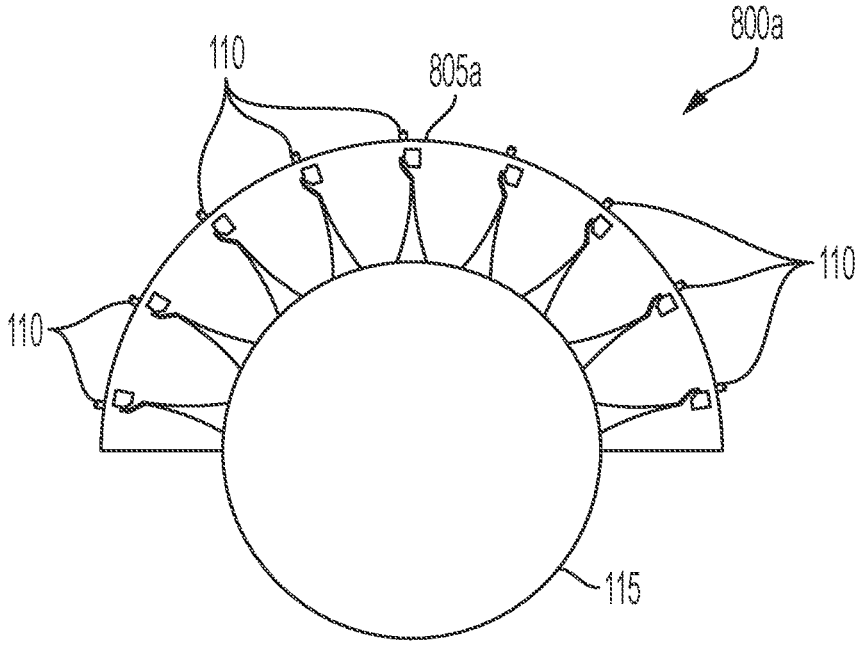
FIG. 8*a* illustrates an exemplary antenna having a 180-degree partial arc radiator ring.
Figure 8B:
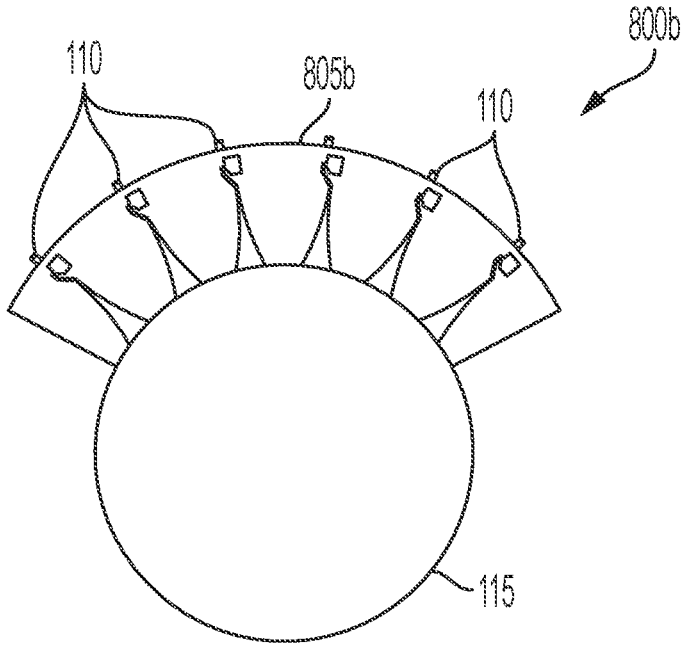
FIG. 8*b* illustrates an exemplary antenna having a 120-degree partial arc radiator rings.

FIGS. 8*a* and 8*b* respectively illustrate exemplary antennas 800*a* and 800*b*, both of which have partial arc radiator rings, or and "arc configuration". Antenna 800*a* has a radiator "ring" 805*a* that may be one-half arc of radiator ring 105 of antennas 100/200. Radiator ring 805*a* may have nine flared-notch radiators 110 or may have more or fewer, depending on the desired minimum beamwidth. Antenna 800*a* may be useful for deployments in which the intended coverage is confined to a 180-degree region. Similarly, antenna 800*b* has a radiator "ring" 805*b* that has a one-third arc of radiator ring 105 of antenna 100/200. Radiator ring 805*b* may have six flared-notch radiators 110 or may have more or fewer, depending on the desired minimum beamwidth. Antenna 800*b* may be useful for deployments in which the intended coverage is confined to a 120-degree region. An advantage of antennas 800*a*/800*b* is that the flared-notch radiators 110 do not experience interference from having flared-notch radiators 110 on the opposite side of the Luneburg lens 115. This is especially true for antenna 800*b*. The interference caused by the presence of flared-notch radiators 110 on the opposite side of Luneburg lens 115 is most pronounced along the elevation axis (orthogonal to the plane defined by the conductive plate 112 of flared-notch radiator 110 and orthogonal to center radiating axis 135), in which case sidelobes may appear above and below the center radiating axis 135 of each flared-notch radiator 110. Accordingly, antenna 800*b* may be the most immune to this interference.

Figure 9:
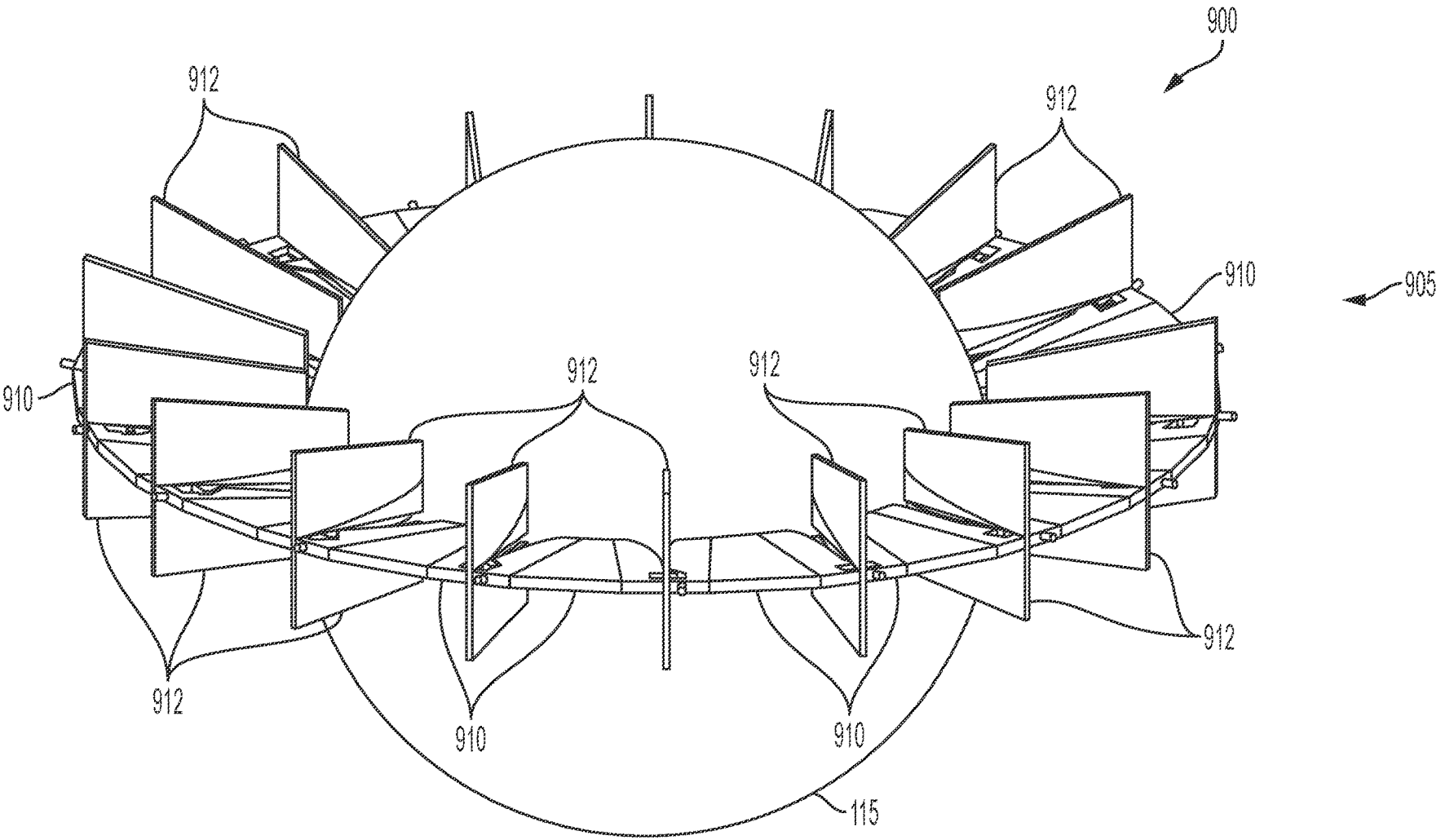
FIG. 9 illustrates an exemplary antenna according to the disclosure having both vertically and horizontally polarized radiators.

FIG. 9 illustrates an exemplary antenna 900 according to the disclosure. The flared-notch radiators 110 of radiator rings 105/805*a*/805*b* described above radiate energy with horizontal polarization (assuming the equatorial plane 125 is oriented horizontally). Antenna 900 may be substantially similar to antennas 100/200/800*a*/800*b* but with the addition of vertically oriented flared-notch radiators 912 that are disposed on radiator rings 105/805*a*/805*b*, forming a dual polarization radiator ring 905. The addition of vertically oriented flared-notch radiators 912 enables antenna 900 to radiate with both vertical and horizontal polarizations. This may improve the quality of link between antenna 900 and a given UE (by radiating a given signal in both polarization states), and it also provides for additional MIMO capability (by radiating different signals in the two polarization states) to a given UE. In a variation, antenna 900 may have a partial arc radiator ring such that radiator ring 905 may cover 180 degrees or 120 degrees of arc, similar to radiator rings 805*a*/805*b*. Given that interference from the presence of flared-notch radiators 110 on the opposite side of Luneburg lens 115 may cause sidelobes in the direction orthogonal to the conductive plane 112 of vertically oriented flared-notch radiator 912 and orthogonal to its center radiating axis 135, and given that the vertically oriented flared-notch radiators 912 are each arranged in this plane defined by each nearest neighboring vertically oriented flared-notch radiator 912, this interference may have a increased effect.

In another variation, antenna 900 may have multiple radiator rings, similarly to antennas 700*a*/700*b* and their variations, with each radiator ring 905 having vertically oriented flared-notch radiators 912. These multiple radiator rings 905 may span a full 360 degrees around Luneburg lens 115, or may have partial arcs (e.g., 180-degree or 120-degree, etc.). It will be understood that such variations are possible and within the scope of the disclosure.

Although the exemplary radiator rings 105/205/705/805*a*/805*b*/905 have been described as having flared-notch radiators 110 spaced at 20 degrees, each having 20-degree beamwidth, it will be understood that variations to this are possible and within the scope of the disclosure. For example, by spacing the flared-notch radiators 100 closer together, it may offer the opportunity of combining more beams (one per flared-notch radiator 110) together to form a given sector. More specifically, as illustrated in FIG. 6, six flared-notch radiators 110 may be combined to form a 120-degree beam with superior beam shape and fast rolloff. By reducing the spacing between flared-notch radiators 110, more of them may be combined to form a 120-degree beam (e.g., combining nine instead of six flared-notch radiators 110), improving beamshaping. Flared-notch radiators 110 spaced more closely together may increase the sidelobes in the gain pattern of each flared-notch radiator 110. These generally combine in a plane defined by radiator ring 105/205/705/805*a*/805*b*/905, but do not combine in the directions (e.g., up/down) orthogonal to the plane.

Although the above exemplary antennas, as described, cover 1695 MHz to 4300 MHz, it will be understood that variations are possible and within the scope of the disclosure. For example, antennas 100/200/700*a*/700*b*/800*a*/800*b*/900 (hereinafter "the exemplary antennas") may be scaled to operate in different frequency regimes. For example, having a Luneburg lens 115 with a diameter of approximately 1 meter may provide all of the capability described above for low band (LB) frequencies.

The relation of Luneburg lens 115 diameter to intended frequency bands may be described as follows. The diameter of Luneburg lens 115 dictates the lower end of the frequencies at which an exemplary antenna may operate, given the desired minimum sector beamwidth. For example, if the desired minimum sector beamwidth is 60 degrees, then one of two approaches is possible. First, if the diameter of the Luneburg lens 115 is fixed, then there is a minimum frequency at which a single flared-notch radiator 110 will provide a 60-degree beamwidth. In this case, there may be no opportunity for beamshaping because the sector beamwidth is fully defined by a single flared-notch radiator 110. Second, if the minimum frequency is fixed, then the diameter of Luneburg lens 115 may be defined so that the beamwidth of a single flared-notch radiator 110 is 60 degrees. Accordingly, if the required low end of the frequency range and the minimum sector beamwidth are known, the diameter of Luneburg lens 115 may be set to a minimum diameter that meets these requirements.

Although the diameter of Luneburg lens 115 dictates the minimum operating frequency for an exemplary antenna, the maximum operating frequency of an exemplary antenna is determined by the integrity of Luneburg lens 115. For example, the exemplary antennas are configured to operate in a frequency range of 1695 MHz to 4300 MHz. Depending on the flared-notch radiators 110 employed, the maximum frequency of the exemplary antennas may extend into the millimeter wave bands. As the frequency increases, the beamwidth of each individual flared-notch radiator 110 tightens into a narrower beam. The high-end limitation of the operating frequency is driven by the integrity of Luneburg lens 115, such that the higher the frequency, the more continuous and precise the gradient of refractive index is required. Accordingly, a Luneburg lens 115 composed of a series of concentric shells as described with regarding to FIGS. 3 and 4 might not offer sufficient resolution to provide adequate focusing of the high frequency beam. In this case, a Luneburg lens 115 having a finer granularity in index gradient may be required.

The exemplary antennas may be scaled accordingly for different frequency regimes. For example, for an antenna that is to operate at 24 GHz to 30 GHz, and if eighteen elements of 20-degree beamwidth each is intended, then an exemplary diameter of Luneburg lens 115 may be between 25 mm and 50 mm. The diameter can be greater than 50 mm if a narrow beamwidth is desired.

The exemplary antennas described above generally regard wideband antennas. The wideband performance is generally enabled by the use of flared-notch radiators 110. However, a variation is possible for narrowband antennas. In this case, a radiator other than a flared-notch radiator may be used, provided that the narrowband radiator has a radiating surface or edge that can abut the outer surface of Luneburg lens 115. An example of this might include a log periodic radiator, such as a printed circuit log periodic radiator. A patch radiator may be used, although the angular extent of the patch where it abuts the outer surface of Luneburg lens 115 may inhibit the focusing action of the lens, leading to less than optimal beamshape.

While various embodiments of the present invention have been described above, it should be understood that they have been presented by way of example only, and not limitation. It will be apparent to persons skilled in the relevant art that various changes in form and detail can be made therein without departing from the spirit and scope of the present invention. Thus, the breadth and scope of the present invention should not be limited by any of the above-described exemplary embodiments but should be defined only in accordance with the following claims and their equivalents.

What is claimed is:

1. An antenna, comprising:

a spherically symmetric gradient-index lens; and a first plurality of flared-notch radiators disposed in a first arc configuration around the spherically symmetric gradient-index lens, each of the first plurality of flared-notch radiators having a traveling wave slot defining a center radiating axis that points toward a center of the spherically symmetric gradient-index lens and a forward edge on either side of the traveling wave slot, wherein each forward edge contacts an outer surface of the spherically symmetric gradient-index lens.

2. The antenna of claim 1, wherein the first arc configuration is disposed along an equatorial plane of the spherically symmetric gradient-index lens.

3. The antenna of claim 1, wherein the first arc configuration is disposed along a latitudinal plane of the spherically symmetric gradient-index lens.

4. The antenna of claim 3, wherein the latitudinal plane has a latitude of 4 degrees.

5. The antenna of claim 3, wherein the latitudinal plane has a latitude of 10 degrees.

6. The antenna of claim 1, wherein the first arc configuration encompasses 360 degrees of arc around an elevation axis of the spherically symmetric gradient-index lens.

7. The antenna of claim 6, wherein the first plurality of flared-notch radiators comprises eighteen flared-notch radiators.

8. The antenna of claim 1, wherein the first arc configuration encompasses 180 degrees of arc around an elevation axis of the spherically symmetric gradient-index lens.

9. The antenna of claim 8, wherein the first plurality of flared-notch radiators comprises nine flared-notch radiators.

10. The antenna of claim 1, wherein the first arc configuration encompasses 120 degrees of arc around an elevation axis of the spherically symmetric gradient-index lens.

11. The antenna of claim 10, wherein the first plurality of flared-notch radiators comprises six flared-notch radiators.

12. The antenna of claim 2, wherein each of the first plurality of flared-notch radiators comprises a conductive plate having an edge, wherein the conductive plate contacts the spherically symmetric gradient-index lens along an edge that is parallel to the equatorial plane.

13. An antenna, comprising:

a spherically symmetric gradient-index lens; and a first plurality of radiators disposed in a first arc configuration around the spherically symmetric gradient-index lens, each of the first plurality of radiators having a center radiating axis that points toward a center of the spherically symmetric gradient-index lens, wherein the first arc configuration is disposed along an equatorial plane of the spherically symmetric gradient-index lens, wherein each of the first plurality of radiators comprises a conductive plate having an edge, and wherein the conductive plate contacts the spherically symmetric gradient-index lens along an edge that is parallel to the equatorial plane, further comprising a second plurality of radiators disposed on the first arc configuration, each of the second plurality of radiators having a center radiating axis that points toward a center of the spherically symmetric gradient-index lens, and each of the second plurality of radiators having a plane that is orthogonal to the conductive plane of a corresponding radiator in the first plurality of radiators.

14. An antenna, comprising:

a spherically symmetric gradient-index lens; and a first plurality of radiators disposed in a first arc configuration around the spherically symmetric gradient-index lens, each of the first plurality of radiators having a center radiating axis that points toward a center of the spherically symmetric gradient-index lens, wherein the first arc configuration is disposed along a latitudinal plane of the spherically symmetric gradient-index lens, further comprising a second plurality of flared notch radiators disposed in a second arc configuration around the spherically symmetric gradient-index lens, the second arc configuration disposed along a second latitudinal plane of the spherically symmetric gradient-index lens, each of the second plurality of flared notch radiators having a center radiating axis that points toward a center of the spherically symmetric gradient-index lens.

15. The antenna of claim 1, wherein the first plurality of flared-notch radiators comprises a contiguous subset of radiators that are coupled to a single RF feed.

16. An antenna, comprising:

a spherically symmetric gradient-index lens; and a first plurality of radiators disposed in a first arc configuration around the spherically symmetric gradient-index lens, each of the first plurality of radiators having a center radiating axis that points toward a center of the spherically symmetric gradient-index lens, wherein the first arc configuration is disposed along a latitudinal plane of the spherically symmetric gradient-index lens, wherein the first plurality of radiators comprises a contiguous subset of radiators that are coupled to a single RF feed; and wherein the contiguous subset of radiators comprises: one or more central radiators within the subset of radiators; and two or more peripheral radiators within the subset of radiators, wherein the peripheral radiators are fed with a signal that is attenuated relative to a corresponding signal fed to the one or more central radiators.

17. The antenna of claim 1, wherein the spherically symmetric gradient-index lens has a diameter that is proportional to a minimum operating frequency of the antenna and a minimum sector beamwidth.

18. The antenna of claim 1, wherein the first arc configuration is disposed along an equatorial plane of the spherically symmetric gradient-index lens.

19. The antenna of claim 1, wherein the first arc configuration is disposed along a latitudinal plane of the spherically symmetric gradient-index lens.

20. The antenna of claim 1, further comprising a second plurality of flared notch radiators disposed on the first arc configuration, each of the second plurality of radiators having a center radiating axis that points toward a center of the spherically symmetric gradient-index lens, and each of the second plurality of radiators having a plane that is orthogonal to the conductive plane of a corresponding radiator in the first plurality of radiators.

21. The antenna of claim 1, further comprising a second plurality of flared notch radiators disposed in a second arc configuration around the spherically symmetric gradient-index lens, the second arc configuration disposed along a second latitudinal plane of the spherically symmetric gradient-index lens, each of the second plurality of flared notch radiators having a center radiating axis that points toward a center of the spherically symmetric gradient-index lens.

22. The antenna of claim 15, wherein the contiguous subset of radiators comprises:

one or more central radiators within the subset of radiators; and two or more peripheral radiators within the subset of radiators, wherein the peripheral radiators are fed with a signal that is attenuated relative to a corresponding signal fed to the one or more central radiators.

* * * * *